US009599926B2

(12) United States Patent
Ishida et al.

(10) Patent No.: US 9,599,926 B2
(45) Date of Patent: Mar. 21, 2017

(54) DEVELOPING UNIT

(71) Applicant: CANON KABUSHIKI KAISHA, Tokyo (JP)

(72) Inventors: Yusuke Ishida, Toride (JP); Katsuya Nose, Matsudo (JP); Kosuke Takeuchi, Abiko (JP); Toshihisa Yago, Toride (JP); Fumiyoshi Saito, Toride (JP); Naoki Mugita, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/631,894

(22) Filed: Feb. 26, 2015

(65) Prior Publication Data

US 2015/0253689 A1 Sep. 10, 2015

(30) Foreign Application Priority Data

Mar. 5, 2014 (JP) ..... 2014-042484

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01); *G03G 15/0921* (2013.01);
(Continued)

(58) Field of Classification Search
CPC ..... G03G 15/09
(Continued)

(56) References Cited

U.S. PATENT DOCUMENTS 6,049,687 A * 4/2000 Hibino ..... G03G 9/10 399/270
6,389,245 B2 * 5/2002 Shida ..... G03G 15/0848 399/274
(Continued)

FOREIGN PATENT DOCUMENTS

JP H08-137270 A 5/1996
JP H11-024407 A 1/1999
(Continued)

OTHER PUBLICATIONS

WO2013162074, Canon Kabushiki Kaisha, International Searching Authority Written Opinion, Apr. 26, 2013.*
(Continued)

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

A developing unit includes a developing container, a developing sleeve, a developer regulating member, and a magnetic field generating portion. The magnetic field generating portion includes a drawing-up pole and a cut pole. In addition, in a peak-to-peak area, the magnetic field generating portion includes at least one of an Fr flat area in which Fr is substantially constant and an Fr attenuation area in which Fr attenuates toward the cut pole side from the drawing-up pole side, and is configured that Fθ is oriented toward the same direction as a direction of rotation of the developing sleeve in the entire peak-to-peak area.

38 Claims, 10 Drawing Sheets

(52) U.S. Cl.
CPC . *G03G 15/0928* (2013.01); *G03G 2215/0609* (2013.01); *G03G 2215/0634* (2013.01)

(58) Field of Classification Search
USPC ..... 399/276–277
See application file for complete search history.

(56) References Cited

U.S. PATENT DOCUMENTS

| | | | | |
|---|---|---|---|---|
| 6,539,192 | B2 * | 3/2003 | Hibino | G03G 15/0921 399/267 |
| 6,704,534 | B2 * | 3/2004 | Hibino | G03G 15/0921 399/275 |
| 6,925,269 | B2 * | 8/2005 | Hibino | G03G 15/0808 399/265 |
| 6,941,090 | B2 * | 9/2005 | Uchida | G03G 15/0942 399/103 |
| 7,010,237 | B2 | 3/2006 | Suzuki et al. | |
| 7,013,095 | B2 | 3/2006 | Ishida | |
| 7,027,746 | B2 | 4/2006 | Suzuki et al. | |
| 7,164,868 | B2 | 1/2007 | Ishida | |
| 7,620,352 | B2 * | 11/2009 | Kawahara | G03G 15/0942 399/277 |
| 7,664,440 | B2 * | 2/2010 | Maezawa | G03G 15/0928 399/267 |
| 7,734,206 | B2 | 6/2010 | Ishida | |
| 8,401,406 | B2 | 3/2013 | Nose | |
| 8,548,361 | B2 | 10/2013 | Noguchi et al. | |
| 8,725,044 | B2 | 5/2014 | Nose et al. | |
| 8,811,854 | B2 | 8/2014 | Nose | |
| 8,874,009 | B2 | 10/2014 | Noguchi et al. | |
| 9,002,242 | B2 | 4/2015 | Ishida | |
| 2013/0164005 | A1 | 6/2013 | Nose | |
| 2015/0010335 | A1 * | 1/2015 | Akita | G03G 15/0921 399/274 |

FOREIGN PATENT DOCUMENTS

| | | | |
|---|---|---|---|
| JP | 2000-250316 A | 9/2000 | |
| JP | 2007-310340 | * 11/2007 | G03G 15/08 |

OTHER PUBLICATIONS

Fumiyoshi Saito, U.S. Appl. No. 14/634,918, filed Mar. 2, 2015.
Yusuke Ishida, U.S. Appl. No. 14/632,298, filed Feb. 26, 2015.
Katsuya Nose et al., U.S. Appl. No. 14/630,883, filed Feb. 25, 2015.

* cited by examiner

DEVELOPING UNIT

BACKGROUND OF THE INVENTION

Field of the Invention

This disclosure relates to a developing unit which develops an electrostatic latent image formed on an image carrier, such as a photoconductive drum, by using a developer including a non-magnetic toner and a magnetic carrier.

Description of the Related Art

In an image forming apparatus, such as a copying machine, a printer, or a facsimile machine, which is an electro-photographic type or an electrostatic recording type, and a multi-purpose peripheral which has a plurality of functions of these apparatuses, visualization (developing) is performed by adhering the developer to an electrostatic latent image which is formed on the image carrier, such as a photoconductive drum. In the developing unit which is used in such developing, in the related art, a technology of using a two-component developer (hereinafter, referred to as a developer) which is made of a toner having non-magnetic particles and a carrier having magnetic particles, is known.

In such a developing unit, the developer is born on a front surface of a developing sleeve which has a magnet disposed on an inner side, and the developer is conveyed by rotation of the developing sleeve. The amount (thickness of a layer) of the developer is regulated by a regulating blade which is disposed in the vicinity of the developing sleeve, and the developer is conveyed to a developing area which opposes the photoconductive drum. Then, the electrostatic latent image which is formed on the photoconductive drum is developed by the toner in the developer.

In addition, in general, a magnet which is disposed on an inner side of the developing sleeve includes a drawing-up pole which draws up and bears the developer in the developing container by the developing sleeve, and a cut pole which is disposed to be adjacent to the drawing-up pole and to be in the vicinity of the regulating blade. The developer which is drawn up by the drawing-up pole is conveyed to the cut pole by the rotation of the developing sleeve, and the thickness of the layer is regulated by the regulating blade. However, at this time, a shear (compression) is applied from the drawing-up pole to the vicinity of the cut pole in the vicinity of the developing sleeve. When the developer receives the compression over a long period of time, there is a possibility that the developer deteriorates, the toner is not uniformly placed with respect to the electrostatic latent image, a uniform transfer is not performed, roughness, such as graininess, is generated on the image, and image density deteriorates. In addition, as the toner is extremely pressed against the developing sleeve, there is a possibility that an uneven density is generated by fusion of the toner with the developing sleeve.

Here, as described in Japanese Patent Application Laid-open No. H11-24407, a configuration in which a drawing-up magnetic pole is provided in the vicinity of the regulating blade and regulation of thickness of the layer of the developer on the developing sleeve is performed by this one magnetic pole, is suggested. As the developer is drawn up and the thickness of the layer is regulated by the one magnetic pole, it is possible to reduce the above-described compression of the developer, and to suppress deterioration of the developer.

However, similar to the above-described technology, when the developer is drawn up and the thickness of the layer is regulated by the one magnetic pole, a magnetic force becomes weak due to a magnet in the vicinity of the developing sleeve. For this reason, there is a possibility that the amount of the developer upstream of the regulating blade becomes unstable, for example, the amount of the developer extremely decreases. Accordingly, there is a case where the amount of the developer which is born on the developing sleeve becomes unstable (coating defect of the developer is generated), and uneven image density caused by the coating defect is generated.

Meanwhile, in a configuration in which two poles, such as the drawing-up pole and the cut pole, are provided, it is considered that deterioration of the developer is reduced by lowering the magnetic force of the drawing-up pole and the cut pole. However, when the magnetic force of the drawing-up pole and the cut pole is simply lowered, similarly to the configuration of the above-described technology, the amount of the developer upstream of the regulating blade extremely decreases, and uneven image density caused by the coating defect of the developer is likely to be generated.

SUMMARY OF THE INVENTION

According to an aspect of this disclosure, there is provided a developing unit including: a developing container configured to store a developer including a non-magnetic toner and a magnetic carrier; a cylindrical developing sleeve configured to bear the developer on a front surface thereof and to rotate; a developer regulating member configured to regulate an amount of the developer born on the developing sleeve; and a magnetic field generating portion configured to be disposed on an inner side of the developing sleeve, and to have a plurality of fixed magnetic poles which generates a magnetic field which bears the developer on the developing sleeve. The magnetic field generating portion includes at least a drawing-up pole which draws up the developer in the developing container, and bears the developer on the developing sleeve, and a cut pole which is disposed to be adjacent to the drawing-up pole downstream of a direction of rotation of the developing sleeve, and to be in the vicinity of the developer regulating member. When a magnetic force in a direction toward the center of the developing sleeve is Fr, and a magnetic force in a tangential direction of the front surface of the developing sleeve is Fθ, in a peak-to-peak area which is a region from a peak of magnetic flux density of the drawing-up pole to a peak of magnetic flux density of the cut pole, the magnetic field generating portion includes at least one of an Fr flat area in which the Fr is substantially constant, and an Fr attenuation area in which the Fr attenuates toward the cut pole side from the drawing-up pole side, and the Fθ is oriented toward the same direction as the direction of rotation of the developing sleeve in the entire peak-to-peak area.

Further features of the present invention will become apparent from the following description of exemplary embodiments (with reference to the attached drawings).

DESCRIPTION OF THE EMBODIMENTS

First Embodiment

Figure 1:
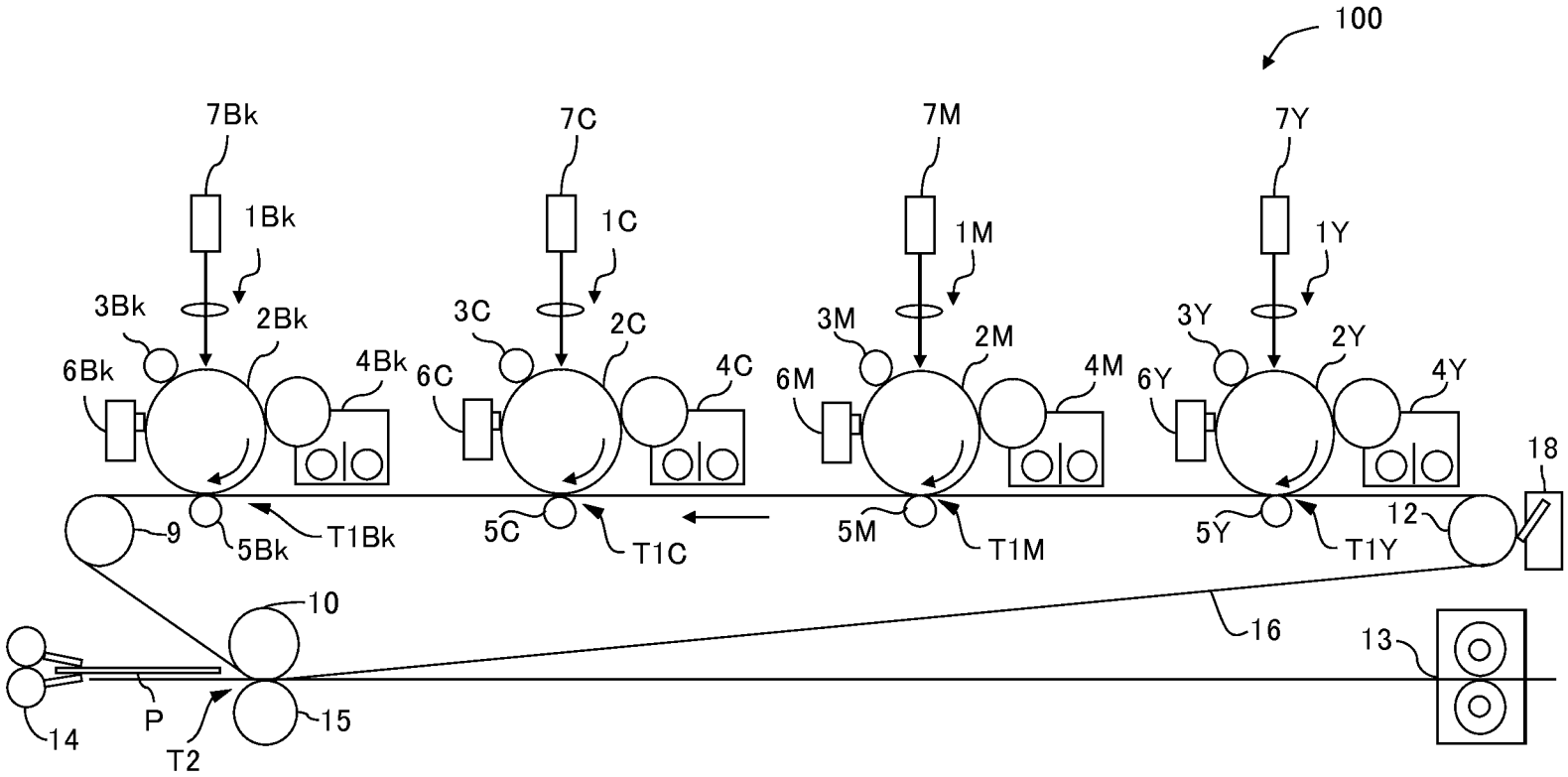
FIG. 1 is a schematic configuration view of an image forming apparatus according to a first embodiment of this disclosure.

A first embodiment of this disclosure will be described with reference to FIGS. 1 to 6. First, a schematic configuration of an image forming apparatus which has a developing unit of the embodiment will be described with reference to FIG. 1.

[Image Forming Apparatus]

An image forming apparatus 100 is an electro-photographic full-color printer which includes four image forming portions 1Y, 1M, 1C, and 1Bk that are provided corresponding to four colors, such as yellow, magenta, cyan, and black. The image forming apparatus 100 forms a toner image (image) on a recording medium P corresponding to an image signal from a host device, such as a scanning apparatus (not illustrated) which is connected to a body of the image forming apparatus, or a personal computer, which is connected so as to be able to communicate with the body of the image forming apparatus. Examples of the recording medium include a sheet material, such as a paper sheet, a plastic film, or a piece of cloth. To schematically describe such an image formation process, first, in each image forming portion 1Y, 1M, 1C, and 1Bk, the toner images of each color are respectively formed on photoconductive drums (electro-photographic photoconductive members) 2Y, 2M, 2C, and 2Bk which function as image carriers. The toner images of each color which are formed in this manner, are transferred onto an intermediate transfer belt 16, and then, are transferred onto the recording medium P from an intermediate transfer belt 16. The recording medium, on which the toner image is transferred, is conveyed to a fixing unit 13, and the toner image is fixed to the recording medium. Hereinafter, this will be described in detail.

In addition, the four image forming portions 1Y, 1M, 1C, and 1Bk which are provided in the image forming apparatus 100 have substantially the same configuration as each other except that the developing colors are different from each other. Therefore, hereinafter, when it is not particularly necessary to be distinguished, suffixes Y, M, C, and Bk, which are adhered to reference numerals for illustrating constituent elements in any of the image forming portions will be omitted, and the overall description will be described.

In an image forming portion 1, a cylindrical photoconductive member which functions as an image carrier, that is, a photoconductive drum 2, is disposed. The photoconductive drum 2 is rotate-driven in an arrow direction in the drawing. A charging roller 3 which functions as a charging portion, a developing unit 4 which functions as a developing portion, a primary transfer roller 5 which functions as a transfer portion, and a cleaning unit 6 which functions as a cleaning portion, are disposed in the periphery of the photoconductive drum 2. A laser scanner (exposing unit) 7, which functions as an exposing portion, is disposed on an upper side of the drawing of the photoconductive drum 2.

In addition, the intermediate transfer belt 16 is disposed to oppose the photoconductive drums 2 of each image forming portion 1. The intermediate transfer belt 16 extends by a drive roller 9, a secondary transfer inner roller 10, and an extension roller 12, and circulates and moves in the arrow direction in the drawing by driving the drive roller 9. At a position which opposes the secondary transfer inner roller 10 while nipping the intermediate transfer belt 16, a secondary transfer outer roller 15 is disposed, and constitutes a secondary transfer portion T2 which transfers the toner image on the intermediate transfer belt 16 to the recording medium P. The fixing unit 13 is disposed downstream of the secondary transfer portion T2 in a direction of conveyance of the recording medium.

A process of forming full-color images of four colors, for example, by the image forming apparatus 100 which is configured as described above, will be described. First, when an image forming operation is started, a front surface of the rotating photoconductive drum 2 is charged by the charging roller 3 in the same manner. At this time, a charging bias is applied to the charging roller 3 by a charging bias power supply. Next, the photoconductive drum 2 is exposed by laser light which corresponds to the image signal which is generated from an exposing unit 7. Accordingly, an electrostatic latent image according to the image signal is formed on the photoconductive drum 2. The electrostatic latent image on the photoconductive drum 2 is developed by a toner stored in the developing unit 4, and is visualized. In the embodiment, a reverse developing type, in which the toner is adhered to a bright portion potential which is exposed by the laser light, is employed.

The toner image which is formed on the photoconductive drum 2 is primarily transferred to the intermediate transfer belt 16, by a primary transfer portion T1 which is configured between the photoconductive drum 2 and the primary transfer roller 5 which is disposed to nip the intermediate transfer belt 16. At this time, a primary transfer bias is applied to the primary transfer roller 5. The toner (residual toner) which remains on the front surface of the photoconductive drum 2 after the primary transfer, is removed by the cleaning unit 6.

This operation is performed in order in each image forming portion of yellow, magenta, cyan, and black, and the toner images of four colors are superposed on the intermediate transfer belt 16. After this, the recording medium P, which is stored in a recording medium storage cassette (not illustrated) matching the timing with the forming of the toner image, is conveyed by the secondary transfer portion T2 from a supply roller 14. Then, by applying a secondary transfer bias to the secondary transfer outer roller 15, the toner images of four colors on the intermediate transfer belt 16 are secondarily transferred onto the recording medium P all together. The toner which is not completely transferred by the secondary transfer portion T2 and remains on the intermediate transfer belt 16, is removed by an intermediate transfer belt cleaner 18.

Next, the recording medium P is conveyed to the fixing unit 13 which functions as a fixing portion. By performing heating and pressing by the fixing unit 13, the toner on the recording medium P is melted, mixed, and fixed to the recording medium P as a full-color image. After this, the recording medium P is discharged to the outside of the apparatus. Accordingly, a series of image formation processes is ended. In addition, by using only a desired image forming portion, it is possible to form an image having a desired single color or plural colors.

[Developing Unit]

Next, the developing unit 4 of the embodiment will be described with reference to FIG. 2. In the embodiment, as described above, the configurations of the developing units of yellow, magenta, cyan, and black are all the same as each other. The developing unit 4 includes a developing container 108 which stores a two-component developer (hereinafter, developer) which has non-magnetic toner particles (toner) and magnetic carrier particles (carrier) as main components.

The toner includes coloring resin particles which have a binder resin, a coloring agent, and other additives if necessary, and coloring particles into which an external additive, such as powder made of colloidal silica, is added. It is preferable that the toner is a polyester resin which is manufactured by a polymerization method and is negatively charged, and a volume average particle diameter is 5 μm to 8 μm. In the embodiment, the volume average particle diameter of the toner is 6.2 μm. In addition, as the toner, it is possible to use a toner containing wax which is manufactured by a grinding method, or the like.

As the carrier, it is possible to appropriately use, for example, a metal, such as surface-oxidized or unoxidized iron, nickel, cobalt, manganese, chrome, or a rare-earth element, an alloy of these materials, or ferrite oxide. In addition, it is also possible to use a resin coat carrier. A manufacturing method of these magnetic particles is not particularly limited. In the carrier, a weight average particle diameter is 20 μm to 50 μm, and is preferably 30 μm to 40 μm. Resistivity is equal to or greater than $10^7$ Ω·cm, and is preferably equal to or greater than $10^8$ Ω·cm. In the embodiment, the resistivity is $10^8$ Ω·cm. In addition, in the embodiment, as a magnetic carrier having a low specific gravity, a resin magnetic carrier which is manufactured by the polymerization method by mixing magnetic metal oxide and non-magnetic metal oxide into a phenolic binder resin at a predetermined ratio is used. In addition, the volume average particle diameter of the carrier is 35 μm, true density is 3.6 g/cm$^3$ to 3.7 g/cm$^3$, and a magnetization amount is 53 A·m$^2$/kg.

The inside of the developing container 108 is divided into a developing chamber 113 and a stirring chamber 114 by a partition 106 which extends in a vertical direction, and an upper portion of the partition 106 is opened. In the developing chamber 113 and the stirring chamber 114, developers are respectively stored, and the developer which is an extra developer in the developing chamber 113 is collected on the stirring chamber 114 side.

In the developing chamber 113 and the stirring chamber 114, a first stirring screw 111 and a second stirring screw 112 are respectively disposed. The first stirring screw 111 stirs and conveys the developer in the developing chamber 113, and the second stirring screw 112 stirs and conveys the developer in the stirring chamber 114. In addition, the toner is replenished from a toner replenish tank (not illustrated) to the upstream side of the stirring chamber 114 in the direction of conveyance of the second stirring screw 112. Then, by the second stirring screw 112, the replenished toner is stirred with the developer already stored in the stirring chamber 114 and is conveyed, and toner density becomes uniform.

Figure 2:
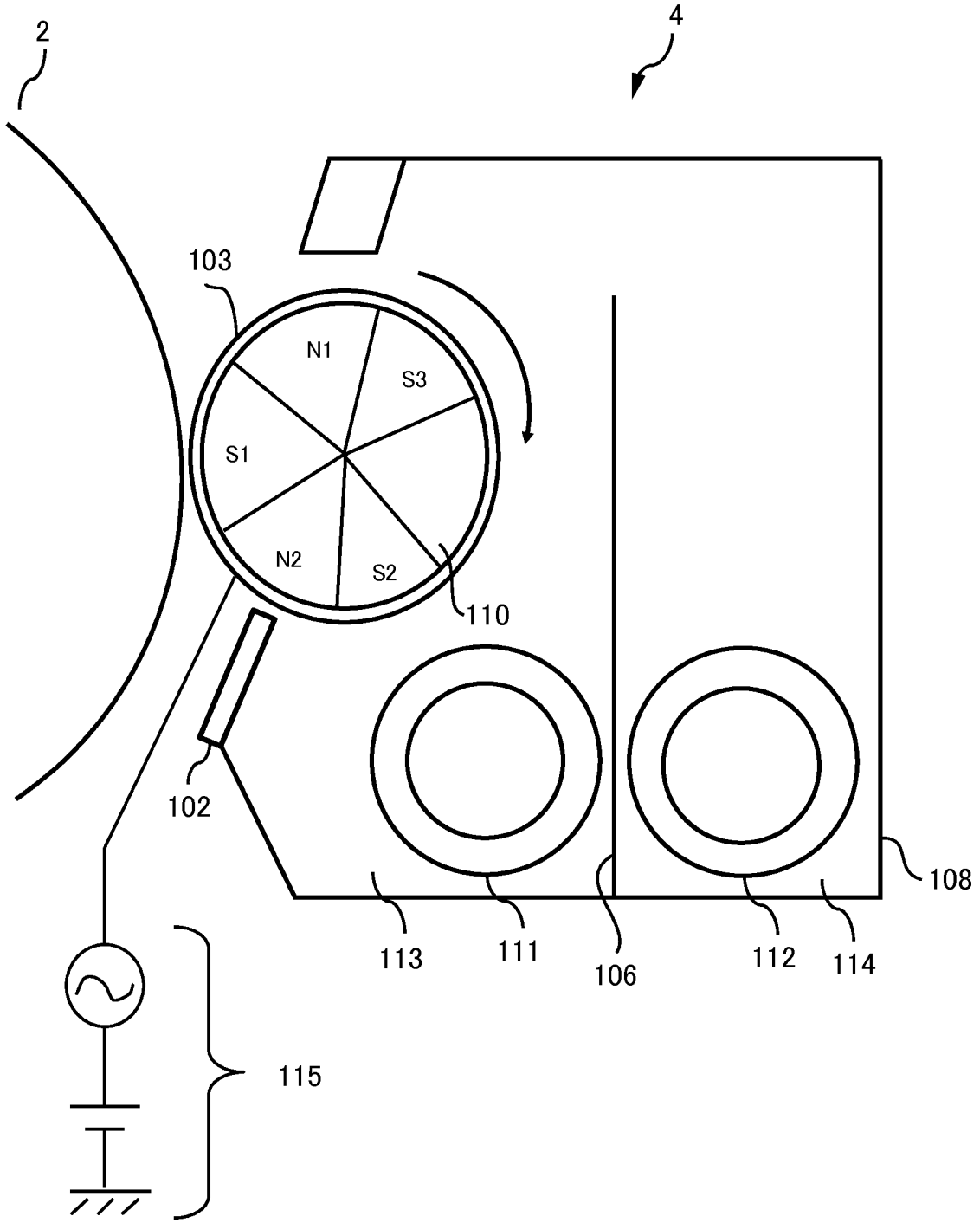
FIG. 2 is a schematic configuration view of a developing unit according to the first embodiment.

In end portions (end portions on the upstream side and the downstream side in the direction of conveyance of the first and the second stirring screws) on a near side and a far side in FIG. 2 in the partition 106, developer paths (not illustrated) which mutually communicate with the developing chamber 113 and the stirring chamber 114 are respectively formed. By a conveying force of the first and the second stirring screws 111 and 112, the developer circulates between the developing chamber 113 and the stirring chamber 114. Accordingly, the developer inside the developing chamber 113, in which the toner is consumed by developing and the toner density deteriorates, moves into the stirring chamber 114, and the developer which is stirred and conveyed together with the toner replenished in the stirring chamber 114 moves into the developing chamber 113.

A part of the developing chamber 113 which corresponds to an area that faces the photoconductive drum 2 is opened, and a developing sleeve 103 is disposed to be rotatable and to be partially exposed to this opening. The developing sleeve 103 is configured to have a cylindrical shape, for example, by an aluminum alloy, and rotates in an arrow direction in the drawing when a developing operation is performed. In addition, on the inner side of the developing sleeve 103, a magnet 110 which functions as a magnetic field generating portion is disposed to be fixed, and the developing sleeve 103 bears the developer on the front surface thereof by a magnetic field of the magnet 110, and rotates. In addition, in the periphery of the developing sleeve 103, a regulating blade 102 which functions as a developer regulating member is disposed so that a distal end closely opposes a part of the front surface of the developing sleeve 103.

The developing sleeve 103 is surface-roughened by using a sandblast on the front surface thereof. On the front surface which has high frictional resistance as the front surface is roughened, it is possible to draw up and convey more developer. It is preferable that a developer sleeve surface roughness Rz is approximately 8 μm to 18 μm for stability of a developer conveying force, and in the embodiment, by using an FGB as the sandblast, the surface roughness Rz of the developing sleeve 103 is 13 μm.

The regulating blade 102 regulates an amount (thickness of a layer) of the developer which is born and conveyed by the developing sleeve 103. The developer of which the thickness of the layer is regulated by the regulating blade 102 is conveyed to the developing area (a developing position) which opposes the photoconductive drum 2 while being born on the developing sleeve 103. Here, in the embodiment, the regulating blade 102 is made of stainless steel. In addition, a predetermined gap is provided between the front surface (front surface of a non-grooved portion) of the developing sleeve 103 and the regulating blade 102. In the embodiment, this gap is 300 μm.

Figure 3:
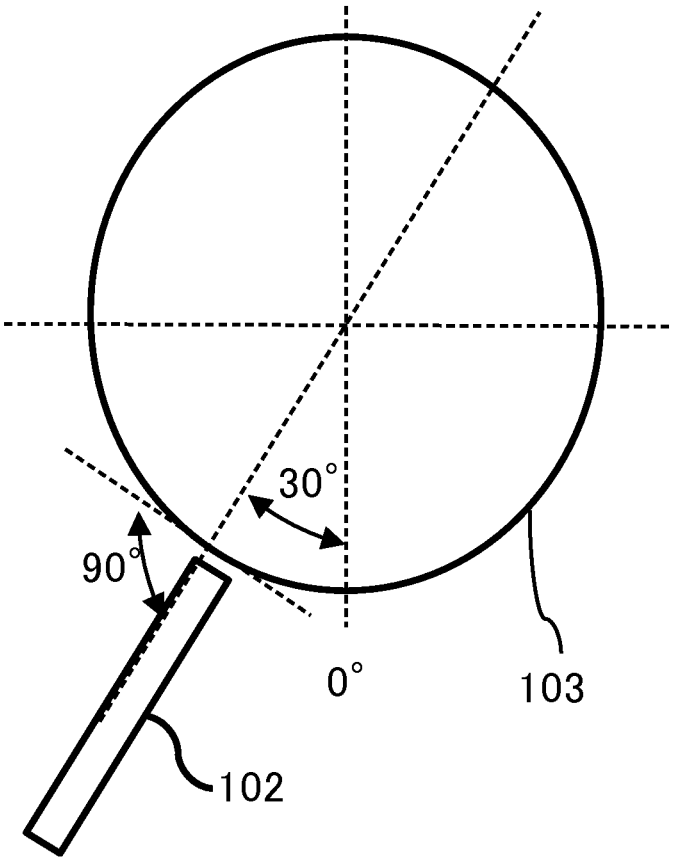
FIG. 3 is a schematic view illustrating a relationship between a developing sleeve and a regulating blade according to the first embodiment.

In addition, an opposing position of the regulating blade 102 with respect to the developing sleeve 103 is as illustrated in FIG. 3. In other words, an angle, which is made of a line that links the lowest point of the developing sleeve 103 in a direction of gravitational force and a center point of the developing sleeve 103, and a line that links the closest point of the regulating blade 102 with respect to the developing sleeve 103 and a center point of the developing sleeve 103, is 30°. In addition, the regulating blade 102 is disposed so that an angle with respect to a tangent of the front surface of the developing sleeve 103 is 90°.

The magnet 110 has a plurality of fixed magnetic poles. For example, the magnet 110 is configured by assembling a plurality of magnet pieces, and as illustrated in FIG. 2, the magnet 110 is magnetized so that the plurality of magnet poles, S1, S2, S3, N1, and N2, is disposed in a circumferential direction. Here, the S2 pole which is the closest to the first stirring screw 111 is a drawing-up pole which draws up the developer in the developing container (in the developing chamber 113) and bears the developer on the developing sleeve 103. The N2 pole which is adjacent to the drawing-up pole (S2) downstream in a direction of rotation of the developing sleeve 103, is a cut pole which is disposed in the vicinity (vicinity of the developer regulating member) of the regulating blade 102. The S1 pole which is adjacent to the cut pole (N2) downstream in the direction of rotation of the developing sleeve 103, is a developing pole which opposes (the closest to) the photoconductive drum 2. The magnet 110 includes the developing pole (S1) which is disposed to oppose the developing area. Downstream of the developing pole (S1) in the direction of rotation of the developing sleeve 103, the N1 pole and the S3 pole are disposed in order. As the S3 pole nips an area having low magnetic flux density and is adjacent to the S2 pole, a repulsive pole (peeling pole) which peels off the developer from the front surface of the developing sleeve 103 is provided. In FIG. 2, the magnet 110 is partitioned into a plurality of cross-sectional fan-shaped magnet pieces, and boundary portions of each piece are displayed by lines. A peak position of the magnetic pole in the embodiment is positioned substantially in the center portion, in arc portions of each fan-shaped partitioned piece.

In the embodiment, as the plurality of magnetic poles is disposed (configured of five poles) along the direction of rotation of the developing sleeve 103 in this manner, the developer in the developing container is born and conveyed by the developing sleeve 103. In other words, as the developer is stirred and conveyed by the first and the second stirring screws 111 and 112, the developing unit 4 charges each of the toner and the carrier. Then, the developer is restricted by a magnetic force of the magnetic pole (drawing-up pole) S2 for conveyance in order to draw up the developer, and is conveyed by the rotation of the developing sleeve 103. In order to restrict the stabilized developer, the developer is sufficiently restricted by the magnetic pole (cut pole) N2 for conveyance having magnetic flux density over a certain level, forms a magnetic brush, and is conveyed. Next, the amount (thickness of the layer) of the developer is appropriately set by ear-cutting the magnetic brush by the regulating blade 102.

Then, a developing bias which is superposed by a direct current and an alternating electric field is applied to the developing sleeve 103 via a power supply 115 which is provided on the image forming apparatus body side by the developing pole S1. Accordingly, the toner on the developing sleeve 103 is moved to the electrostatic latent image side of the photoconductive drum 2, and the electrostatic latent image is developed as the toner image. In other words, the developing sleeve 103 develops the electrostatic latent image which is formed on a front surface of a photoconductive drum 2 at the developing area which opposes the photoconductive drum 2. In addition, the developing bias is a bias in which an AC voltage is superposed with a DC voltage, and in the embodiment, a rectangular wave of the AC voltage having 10 kHz of frequency and 1000 V of amplitude, is used. The developer which finishes developing is conveyed to the peeling magnetic pole S3 via the taking-in magnetic pole N1, and is taken into the developing container by the peeling magnetic pole S3.

[Magnetic Force and Groove Pitch Interval of Magnet]

Figure 4:
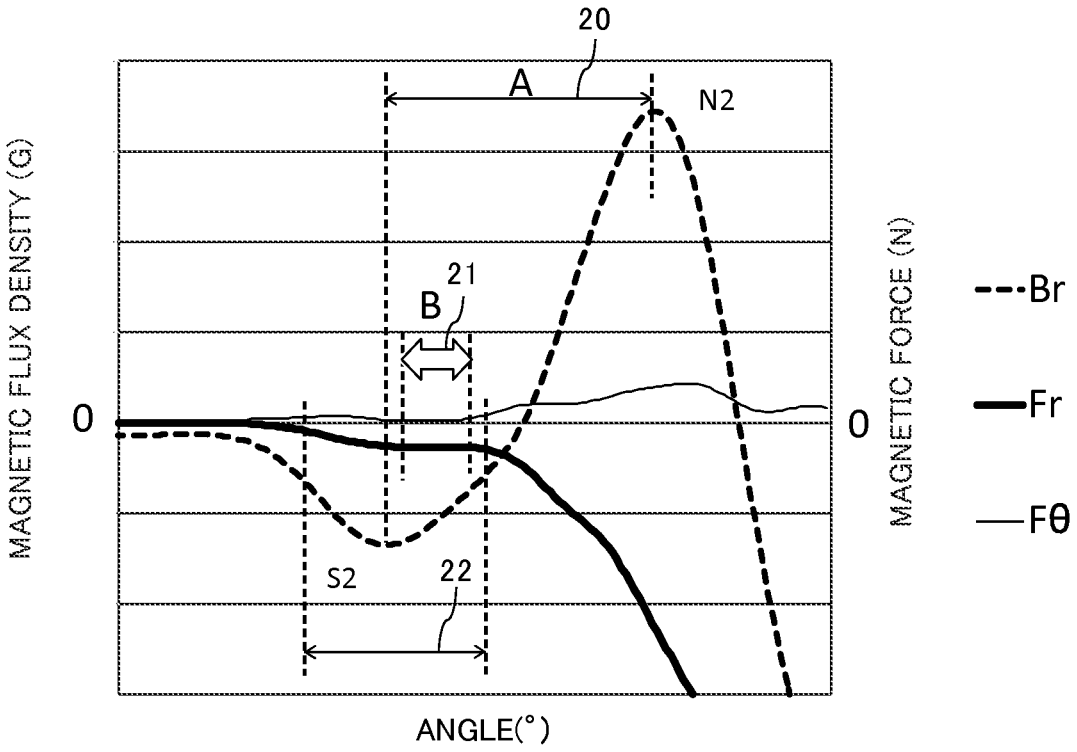
FIG. 4 is a view illustrating a relationship between magnetic flux density and a magnetic force in the vicinity of a drawing-up pole (S2) and a cut pole (N2) of the magnet, and an angle of the magnet, according to the first embodiment.

Here, the magnetic force of the magnet 110 having a plurality of magnetic poles as described above, will be described with reference to FIG. 4. FIG. 4 illustrates a relationship between the magnetic flux density and the magnetic force of the front surface of the developing sleeve in the vicinity of the S2 and the N2 poles, and an angle (position) of the magnet 110. In addition, in the embodiment, the magnetic force of the front surface of the developing sleeve 103 in a normal line direction is Fr (thick line), the magnetic force in a tangential direction is Fθ (thin line), and the magnetic flux density in the normal line direction is Br (dashed line). In addition, regarding Fr in FIG. 4, a magnetic force toward the outside from the center of the developing sleeve 103 is a positive magnetic force, and a magnetic force toward the center of the developing sleeve 103 is a negative magnetic force. However, hereinafter, as a force toward the center of the developing sleeve 103 is mainly considered as Fr. Therefore, for example, an expression that Fr attenuates means that the force toward the center of the developing sleeve 103 attenuates. In addition, regarding Fθ, a magnetic force toward the developing sleeve 103 in the same direction as the direction of rotation is a positive magnetic force, and a magnetic force toward an opposite direction is a negative magnetic force.

In order to stabilize a coating amount (an amount born on the developing sleeve 103) of the developer, it is necessary to increase the magnetic flux density of the cut pole (N2) to a certain level, and in general, it is preferable that an absolute value is approximately 350 G to 800 G. The absolute value in the embodiment is 550 G. The magnetic flux density of the drawing-up pole (S2) may be at least high for drawing up the developer from the developing chamber 113, and in general, it is preferable that the absolute value is approximately 150 G to 700 G. The absolute value in the embodiment is 300 G. In other words, the magnetic flux density of the cut pole is larger than the magnetic flux density of the drawing-up pole. In addition, the level of the magnetic flux density is arbitrarily set by the configuration of the developing unit.

In the embodiment, Fr and Fθ are as follows in a peak-to-peak area 20 from a peak of the magnetic flux density of the drawing-up pole to a peak of magnetic flux density of the cut pole. In the embodiment, the peak-to-peak area 20 is a region from an angle of the magnet 110 which is made of a peak of the magnetic flux density of the drawing-up pole, to an angle which is made of a peak of magnetic flux density of the cut pole. In other words, the magnet 110 has at least one of an Fr flat area 21 in which Fr does not substantially change and is substantially constant, and an Fr attenuation area in which Fr attenuates from the drawing-up pole side toward the cut pole side. Together with this, in the magnet 110, in the entire peak-to-peak area 20, Fθ is oriented toward the same direction as the direction of rotation of the developing sleeve 103. In particular, the Fr flat area 21 and/or the Fr attenuation area are positioned in the vicinity of the drawing-up pole. In the embodiment, the magnet 110 includes the Fr flat area 21. In addition, in the embodiment, in the entire area from the peak position of the magnetic flux density of the drawing-up pole to the position which opposes the distal end of the regulating blade 102, Fθ is positive. In addition, in the embodiment, regarding the direction of rotation of the developing sleeve 103, in the entire angle area from the peak position of the magnetic flux density of the cut pole to the peak position of the magnetic flux density of the developing pole (S1), the Fθ is also positive. In addition, in the embodiment, in the entire area from the position which opposes the distal end of the regulating blade 102 to the position which is the closest to the developing sleeve 103 and the photoconductive drum 2, Fθ is also positive.

In other words, since the peeling pole exists upstream of the drawing-up pole in the direction of rotation of the developing sleeve 103, Fr gradually increases toward the drawing-up pole from a state where the magnetic force is substantially zero. In the embodiment, the Fr flat area 21 (or the Fr attenuation area in which Fr attenuates), in which Fr which tends to ascend in this manner does not substantially change and is substantially constant in the middle of facing the cut pole from the drawing-up pole, is provided. Accordingly, the level of Fr in the Fr flat area 21 can decrease compared to a case where Fr keeps ascending. In the embodiment, a numerical value range of Fr is from $1\times10^{-8}$ (N) to $1.5\times10^{-7}$ (N). When Fr is less than $1\times10^{-8}$ (N), the developer is not efficiently conveyed. In addition, when Fr is greater than $1.5\times10^{-7}$ (N), it is not possible to sufficiently suppress deterioration of the developer. In addition, in an area following the Fr flat area 21 and/or the Fr attenuation area, Fr keeps gradually ascending again. In addition, regarding Fθ, the magnetic force is generated in the same direction as the direction of rotation of the developing sleeve 103 toward the drawing-up pole from the state where the magnetic force is substantially zero, and the magnetic force tends to decrease in the Fr flat area 21. However, in the embodiment, in this area, Fθ is also positive, and is in the same direction as the direction of rotation of the developing sleeve 103. In addition, in the area following this, Fθ is also in the same direction as the direction of rotation of the developing sleeve 103.

In addition, regarding Fθ, in a half-value area 22 in which the magnetic flux density becomes an absolute value which is greater than an absolute value of a half of the peak value of the magnetic flux density of the drawing-up pole, the Fθ is positive and is oriented toward the same direction as the direction of rotation of the developing sleeve 103.

Setting of the magnetic force is performed by adjusting an absolute value or an inclination of the magnetic flux density Br. Adjustment of Br is performed when the magnet 110 is magnetized. In addition, for example, there is a case where a size or a shape of the plurality of magnet pieces which constitutes the magnet 110 is adjusted.

This will be described in more detail. First, the magnetic force is obtained by the following calculation method. The magnetic force which is operated by the carrier is obtained by the following Expression (1). Here, μ0 is vacuum magnetic permeability, μ is magnetic permeability of the carrier, b is a radius of the carrier, and B is a magnetic flux density.

[Expression 1]

$$\vec{F} = \frac{\mu - \mu_0}{\mu_0(\mu + 2\mu_0)} 2\pi b^3 \nabla B^2 \tag{1}$$

Therefore,

[Expression 2]

$$\vec{F} \propto \nabla B^2 = \frac{\partial}{\partial r}(Br^2 + B\theta^2)\vec{e}_r + \frac{1}{r}\frac{\partial}{\partial\theta(B_r^2 + B_\theta^2)}\vec{e}_\theta \therefore \tag{2}$$

$$\vec{F} \propto \underbrace{\left(B_r\frac{\partial B_r}{\partial r} + B_\theta\frac{\partial B_\theta}{\partial r}\right)\vec{e}_r}_{Fr} + \underbrace{\frac{1}{r}\left(B_r\frac{\partial B_r}{\partial\theta} + B_\theta\frac{\partial B_\theta}{\partial\theta}\right)\vec{e}_\theta}_{F\theta}$$

In addition, Br is magnetic flux density of the front surface of the developing sleeve 103 in the normal line direction, and Bθ is magnetic flux density in the tangential direction.

From Expression (2), if Br and Bθ are obtained, it is possible to obtain Fr and Fθ. Here, the magnetic flux density Br is measured by setting a distance between a probe which is a member of a measuring instrument and the front surface of the developing sleeve to be 100 μm, by using a magnetic field measuring instrument "MS-9902" (product name) manufactured by F. W. BELL as a measuring instrument.

Furthermore, Bθ can be obtained as follows. A vector potential Az (R, θ) at a measurement position of the magnetic flux density Br can be obtained by using the measured magnetic flux density Br.

[Expression 3]

$$A_z(R, \theta) = \int_\theta^\theta RBr\,d\theta \tag{3}$$

By solving an equation $\nabla^2 Az(R, \theta)=0$, considering that a boundary condition is Az(R, θ), Az(R, θ) is obtained. Then, by this expression,

[Expression 4]

$$B_\theta = -\frac{\partial A_z(r, \theta)}{\partial r} \tag{4}$$

Bθ can be obtained.

By applying Br and Bθ which are measured and calculated as described above into Expression (1), Fr and Fθ can be derived. Setting of the magnetic force is performed by adjusting the absolute value or the peak position of the magnetic flux density Br of the drawing-up pole or the cut pole.

To describe in detail, regarding the adjustment of the absolute value of the magnetic flux density, it is possible to increase the magnetic force between the drawing-up pole and the cut pole by increasing the magnetic flux density of the drawing-up pole and the cut pole. Conversely, by decreasing the magnetic flux density of the drawing-up pole and the cut pole, it is possible to decrease the magnetic force between the drawing-up pole and the cut pole. In addition, regarding the adjustment of the peak position of the magnetic flux density, as the peak position of the magnetic flux density of the drawing-up pole approaches the cut pole, it is possible to increase the magnetic force between the drawing-up pole and the cut pole. Conversely, as the peak position of the magnetic flux density of the drawing-up pole goes far away from the cut pole, it is possible to decrease the magnetic force between the drawing-up pole and the cut pole.

Based on the above-described point of view, in the embodiment, setting is performed as follows. In other words, as the absolute value of the magnetic flux density of the cut pole decreases with respect to the absolute value of the magnetic flux density of the drawing-up pole, it is possible to set that Fr tends to attenuate toward the cut pole from the drawing-up pole, and Fθ tends to become negative. In addition, when the distance between the drawing-up pole and the cut pole widens, it is possible to set that Fr tends to attenuate, and Fθ tends to become negative. The adjustment of the magnetic flux density can realize magnetization conditions (magnetization width, strength, and magnetization position), for example, when the magnet 110 is magnetized, by arbitrarily setting the adjustment. In addition, there is a case where the size or the shape of the plurality of magnet pieces which constitutes the magnet 110 is adjusted.

In addition, the Fr flat area 21 and/or the Fr attenuation area of the embodiment are defined as follows. In other words, an increase amount (increase amount in a negative direction in FIG. 4 is considered as positive) of Fr per unit angle in a range of the angle which is made of lines that link both ends of the Fr flat area 21 and/or the Fr attenuation area and the center of the developing sleeve 103, is ΔFr. In this case, an area which satisfies $\Delta Fr \leq +5\times10^{-9}$ (N) is the Fr flat area 21 and/or the Fr attenuation area. In addition, when $\Delta Fr<0$, the area is the Fr attenuation area in which Fr attenuates. According to an experiment result of the inventor, in the peak-to-peak area 20, as an area which satisfies $\Delta Fr \leq +5\times10^{-9}$ (N) exists, it is found that an effect of suppressing deterioration of the developer is shown.

In this embodiment, the magnetic force from the drawing-up pole to the cut pole has at least one of the Fr flat area 21 and the Fr attenuation area. For this reason, it is possible to maintain the minimum magnetic force for drawing up and bearing the developer by the developing sleeve 103, and to reduce compression of the developer from the drawing-up pole to the cut pole. In addition, Fθ of the peak-to-peak area 20 from the drawing-up pole to the cut pole is oriented toward the same direction as the direction of rotation of the developing sleeve 103. For this reason, it is possible to convey the developer by the developing sleeve with high efficiency, and to stabilize the amount (coating amount) of the developer which is born on the developing sleeve. Furthermore, since the Fθ of the half-value area 22 is also positive, and is oriented toward the same direction as the direction of rotation of the developing sleeve 103, it is possible to convey the developer by the developing sleeve with much higher efficiency. In the embodiment, in this manner, it is possible to achieve both the suppression of deterioration of the developer and coating stabilization of the developer on the developing sleeve. As a result, it is possible to form the stabilized images over a long period of time.

Figure 5:
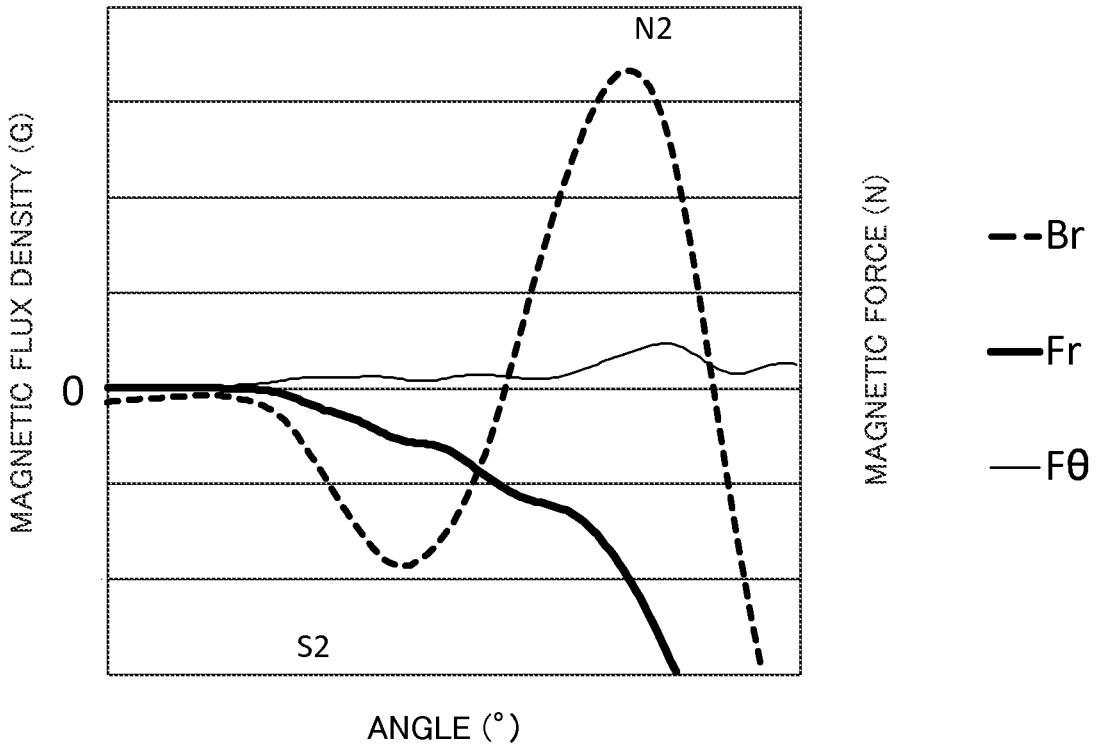
FIG. 5 is a view illustrating a relationship between the magnetic flux density and the magnetic force in the vicinity of the drawing-up pole (S2) and the cut pole (N2) of the magnet, and the angle of the magnet, according to Comparative Example 1.

Here, as illustrated in FIG. 5, Comparative Example 1, in which Fr has a magnetic field pattern of monotonic increase, from the drawing-up pole to the cut pole, will be described. In Comparative Example 1, with respect to the magnetic field pattern of the embodiment illustrated in FIG. 4, since an area in which the developer is strongly pressed against the developing sleeve is widely generated, the developer receives more shear by the magnetic force. As a result, the developer deteriorates as the images are formed for a long period of time, and an image defect, such as roughness of the image or deterioration of image density, is likely to be generated.

Figure 6:
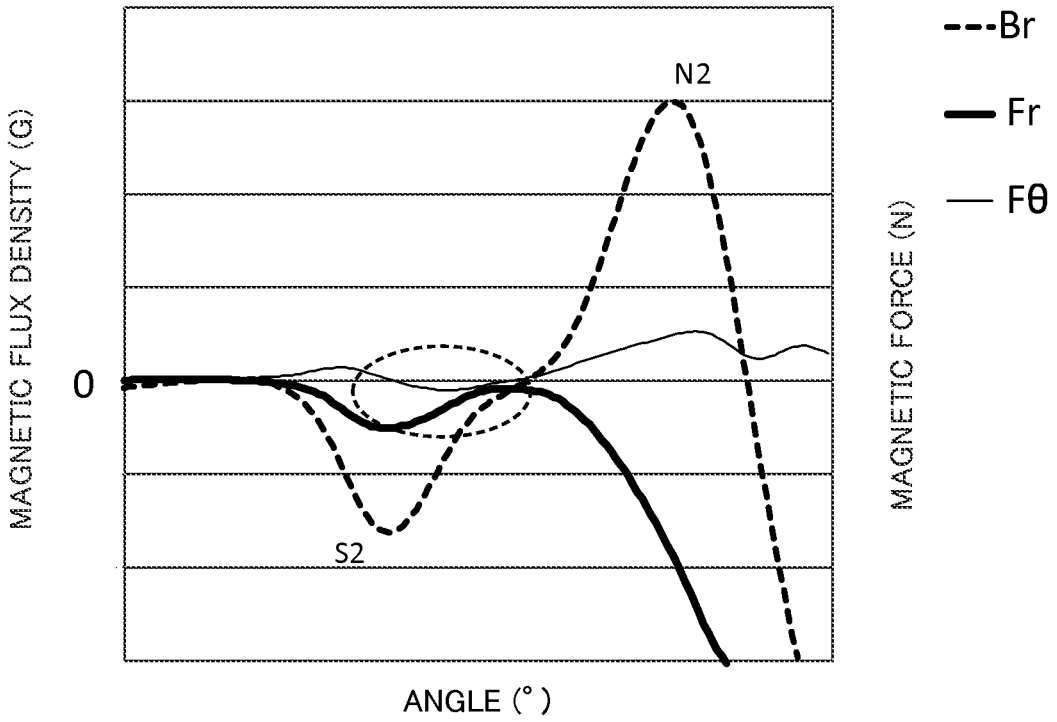
FIG. 6 is a view illustrating a relationship between the magnetic flux density and the magnetic force in the vicinity of the drawing-up pole (S2) and the cut pole (N2) of the magnet, and the angle of the magnet, according to Comparative Example 2.

In addition, as illustrated in FIG. 6, Comparative Example 2, in which an area (area which is surrounded by a dashed line) in which Fθ is oriented toward an opposite direction to the direction of rotation of the developing sleeve is provided from the drawing-up pole to the cut pole, will be described. In Comparative Example 2, since a conveying amount of the developer by the developing sleeve in this area decreases, uneven image density is likely to be generated due to unstable coating of developer.

Here, an experiment, which is performed with respect to both a case where the magnetic pattern of the embodiment illustrated in FIG. 4 is provided, and a case where the magnetic pattern of Comparative Examples 1 and 2 illustrated in FIGS. 5 and 6 is provided, in the image forming apparatus illustrated in FIG. 1, will be described. In the experiment, images were respectively formed with 10% of image duty over a long period of time. In the embodiment, the image defect was not generated even when 100000 images were formed. Meanwhile, in Comparative Example 1, roughness of the image was generated after forming 5000 images, and uneven density was generated due to fusion of the toner to the developing sleeve after forming 30000 images. In addition, in Comparative Example 2, uneven image density was generated due to a coating defect of the developer after forming 2000 images.

In addition, according to the experiment result by the inventor, it is found that it is preferable to satisfy the following conditions in the configuration of the embodiment illustrated in FIG. 4. In other words, an angle, which is made of a line that links the peak of the magnetic flux density of the drawing-up pole and the center of the developing sleeve, and a line that links the peak of the magnetic flux density of the cut pole and the center of the developing sleeve, is A. In addition, an angle, which is made of lines that link both ends of the Fr flat area 21 and/or the Fr attenuation area and the center of the developing sleeve, is B. In this case, it is found that it is preferable to satisfy $0.12 \leq B/A < 0.65$.

$0.12 \leq B/A$ is required because, when an area in which Fr becomes flat or attenuates does not exist in a range which is equal to or greater than $0.12 \leq B/A$, the effect with respect to deterioration of the developer decreases. Meanwhile, when the area in which Fr becomes flat or attenuates is great (when $B/A \geq 0.65$), the amount of the developer which is conveyed to the cut pole extremely decreases, and unstable coating of the developer is generated. In the embodiment, A=60°, B=12°, and B/A=0.2.

In addition, the developing unit 4 of the embodiment can be used in the image forming apparatus, such as a copying machine, a printer, or a facsimile, which is an electrophotographic type or an electrostatic recording type, and a multi-purpose peripheral which has a plurality of functions of these apparatuses.

Second Embodiment

Figure 8:
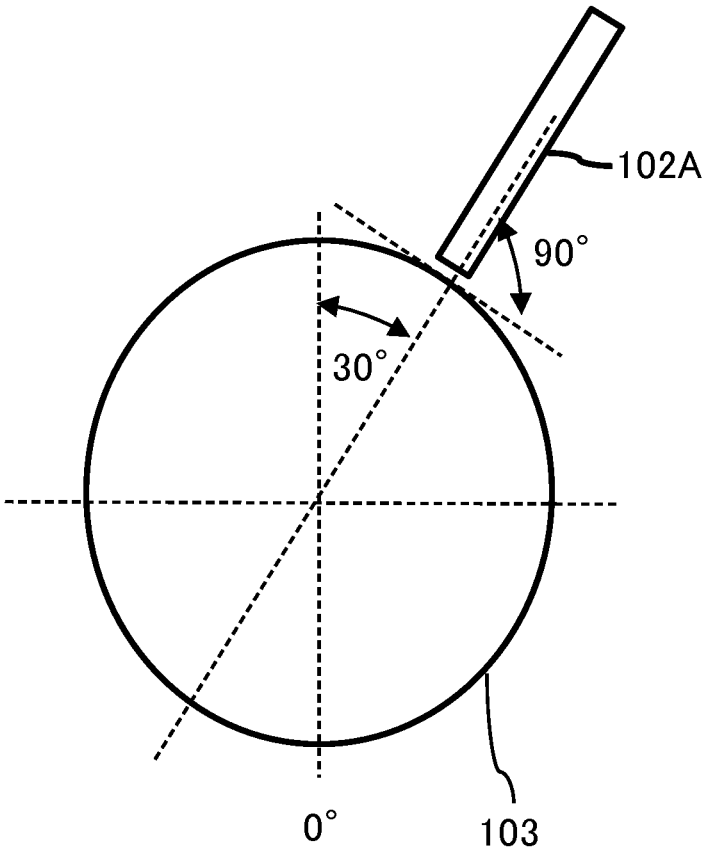
FIG. 8 is a schematic view illustrating a relationship between the developing sleeve and the regulating blade according to the second embodiment.
Figure 9:
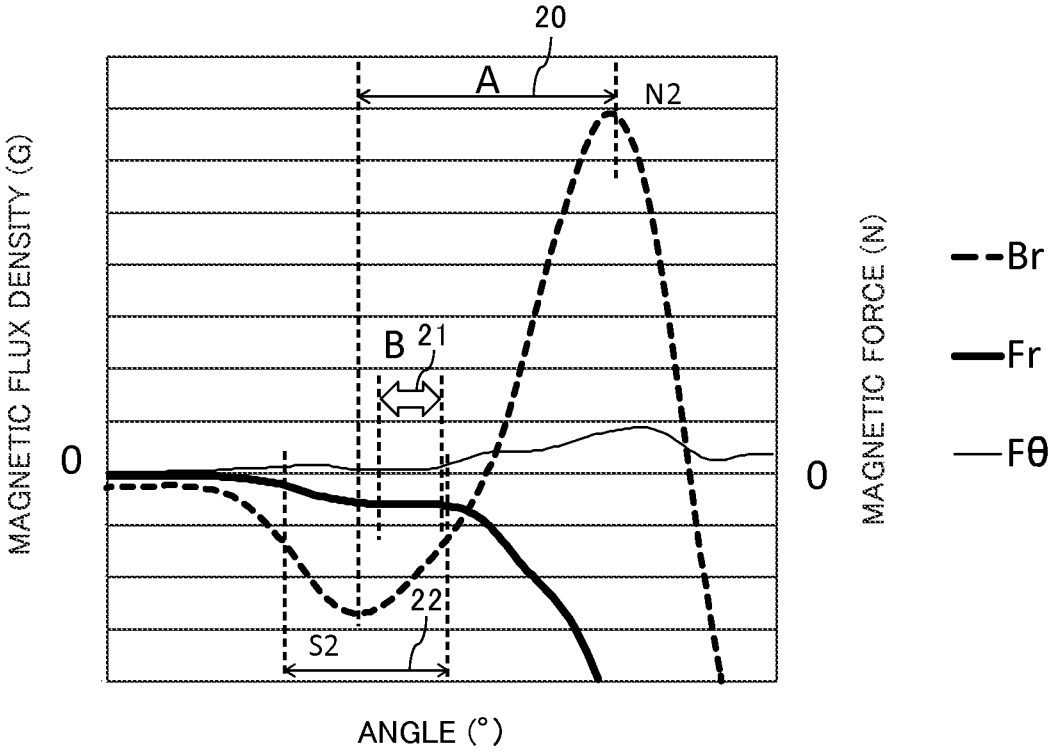
FIG. 9 is a view illustrating a relationship between the magnetic flux density and the magnetic force in the vicinity of the drawing-up pole (S2) and the cut pole (N2) of the magnet, and the angle of the magnet, according to the second embodiment.

A second embodiment of this disclosure will be described with reference to FIGS. 7 to 9. In the embodiment, a configuration of the developing unit is different from the above-described configuration of the first embodiment. Specifically, in the developing unit 4 of the first embodiment, the regulating blade 102 is disposed below a horizontal line which passes the center of the developing sleeve 103. In contrast, in a developing unit 4A of the embodiment, a regulating blade 102A is disposed above the horizontal line which passes the center of developing sleeve 103. According to this, the position of the plurality of magnetic poles of a magnet 110A, which functions as the magnetic field generating portion, is different from that of the magnet 110 of the first embodiment. Since other configurations and operations are similar to those of the first embodiment, hereinafter, the different parts will be mainly described.

Figure 7:
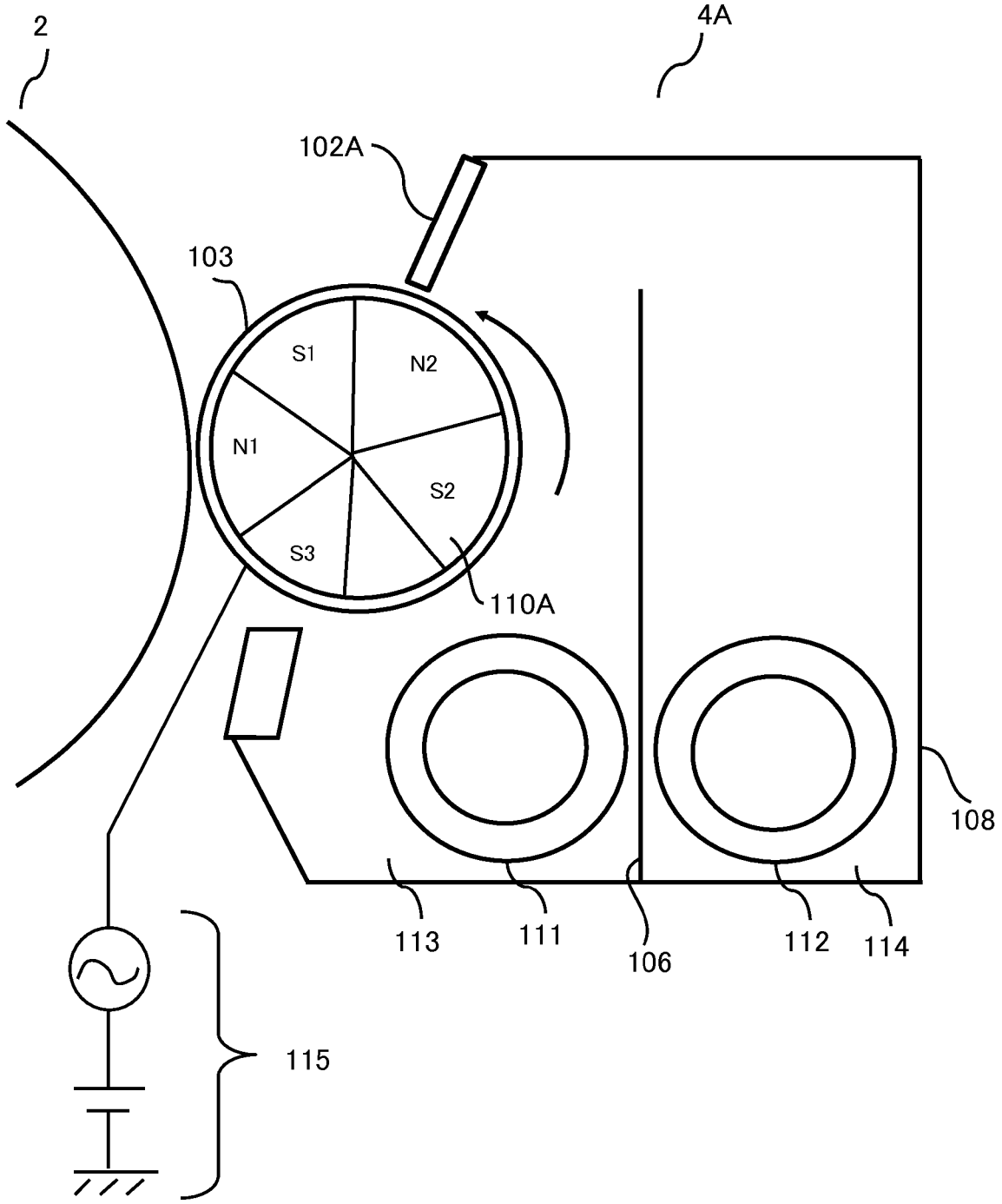
FIG. 7 is a schematic configuration view of the developing unit according to a second embodiment of this disclosure.

In the embodiment, the developing sleeve 103 rotates in a direction illustrated by an arrow in FIG. 7. In addition, an opposing position of the regulating blade 102A with respect to the developing sleeve 103 is as illustrated in FIG. 8. In other words, an angle, which is made of a line that links an uppermost point of the developing sleeve 103 in a direction of gravitational force and a center point of the developing sleeve 103, and a line which links the closest point of the regulating blade 102A with respect to the developing sleeve 103 and the center point of the developing sleeve 103, is 30°. In addition, the regulating blade 102A is disposed so that an angle with respect to a tangent on the front surface of the developing sleeve 103 is 90°.

As illustrated in FIG. 7, the magnet 110A is magnetized so that a plurality of magnetic poles, S1, S2, S3, N1, and N2, is disposed in the circumferential direction. Here, the S2 pole which is the closest to the first stirring screw 111 is a drawing-up pole which draws up the developer in the developing container (in the developing chamber 113) and bears the developer by the developing sleeve 103. The N2 pole which is adjacent to the drawing-up pole (S2) downstream of a direction of rotation of the developing sleeve 103, is a cut pole which is disposed in the vicinity (vicinity of the developer regulating member) of the regulating blade 102. The S1 pole which is adjacent to the cut pole (N2) downstream of the direction of rotation of the developing sleeve 103, is a conveying pole which conveys the developer, and the N1 pole which opposes the photoconductive drum 2 downstream of the conveying pole S1 is a developing pole. Downstream of the developing pole (N1) in the direction of rotation of the developing sleeve 103, the S3 pole is disposed. As the S3 pole nips an area having low magnetic flux density and is adjacent to the S2 pole, a repulsive pole (peeling pole) which peels off the developer from the front surface of the developing sleeve 103 is configured.

In this configuration, the developing unit 4A bears the developer which is supplied to the front surface of the developing sleeve 103 by the first and the second stirring screws 111 and 112 in a state of being the magnetic brush by a magnetic force of the magnet 110A. Then, the developer is conveyed to a portion (developing area) which opposes the photoconductive drum 2 based on the rotation of the developing sleeve 103, and the amount of the developer which is conveyed to the developing area by ear-cutting the magnetic brush by the regulating blade 102A is appropriately maintained. Furthermore, after passing through the conveying pole S1, a bias voltage which is superposed by the direct current and the alternating electric field is applied to the developing sleeve 103 via a power supply 115 which is provided on the image forming apparatus body side by the developing pole N1. Accordingly, the toner on the developing sleeve 103 is moved to the electrostatic latent image side of the photoconductive drum 2, and the electrostatic latent image is developed as the toner image. Then, the developer which finishes developing is taken into the developing container by the peeling magnetic pole S3.

Here, the magnetic force of the magnet 110A having the plurality of magnetic poles as described above, will be described with reference to FIG. 9. Similarly to the above-described FIG. 4, FIG. 9 illustrates a relationship between the magnetic flux density and the magnetic force on the front surface of the developing sleeve in the vicinity of the poles S2 and N2, and the angle of the magnet 110. In addition, in the embodiment, similarly to the first embodiment, in general, it is also preferable that the absolute value of the magnetic flux density of the cut pole (N2) is approximately 350 G to 800 G, and the absolute value of the embodiment is 550 G. In addition, in general, it is preferable that the absolute value of the magnetic flux density of the drawing-up pole (S2) is 150 G to 700 G, and the absolute value of the embodiment is 300 G.

In the embodiment, similarly to the first embodiment, Fr and Fθ are also as follows, in the peak-to-peak area 20 from the angle of the magnet 110 which is made of the peak of the magnetic flux density of the drawing-up pole, to the angle which is made of the peak of magnetic flux density of the cut pole. In other words, the magnet 110 has at least one of the Fr flat area 21 in which Fr does not substantially change and is substantially constant from the drawing-up pole side toward the cut pole side, and the Fr attenuation area in which Fr attenuates. Together with this, in the magnet 110, in the entire peak-to-peak area 20, Fθ is oriented toward the same direction as the direction of rotation of the developing sleeve 103. In particular, the Fr flat area 21 and/or the Fr attenuation area are positioned in the vicinity of the drawing-up pole. In the embodiment, the magnet 110 includes the Fr flat area 21.

In addition, regarding Fθ, in the half-value area in which the magnetic flux density becomes the absolute value which is greater than the absolute value of the half of the peak value of the magnetic flux density of the drawing-up pole, the Fθ is positive and is oriented toward the same direction as the direction of rotation of the developing sleeve 103.

In this embodiment, similarly to the first embodiment, it is also possible to reduce the shear which is given to the developer in the peak-to-peak area 20 of the cut pole from the drawing-up pole, and to stabilize the conveyance of the developer by the developing sleeve 103. As a result, it is possible to achieve both the suppression of deterioration of the developer and coating stabilization of the developer on the developing sleeve 103, and to form the stabilized images over a long period of time.

Third Embodiment

Figure 10A:
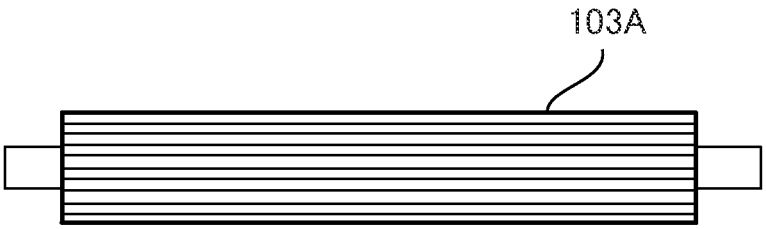
FIG. 10A is a plan view of the developing sleeve according to a third embodiment.
Figure 10B:
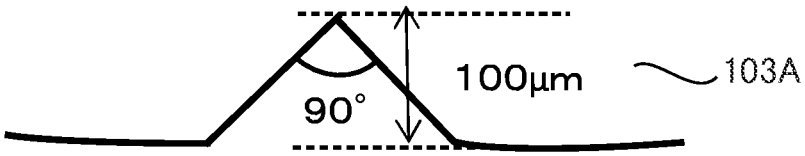
FIG. 10B is a section view illustrating an enlarged groove of the developing sleeve according to the third embodiment.

A third embodiment of this disclosure will be described with reference to FIGS. 10A and 10B. In the embodiment, a configuration of the developing sleeve is different from that of the above-described first embodiment. Specifically, as illustrated in FIG. 10A, a developing sleeve 103A is a so-called groove sleeve which has a plurality of grooves that are respectively formed in a direction (parallel to an axial direction of the developing sleeve 103A in the embodiment) which intersects the circumferential direction on the front surface. Since other configurations and operations are similar to those of the first embodiment, hereinafter, the different parts will be mainly described.

In the above-described first embodiment, a configuration in which the front surface of the developing sleeve 103 is roughened by using the sandblast, is described. The FGB is used as the sandblast. However, when the surface is roughened by the sandblast, there is a problem as follows.

In general, the developing sleeve, which is configured to convey the two-component developer with high efficiency, and of which the front surface is roughened by using the sandblast similarly to the first embodiment, is known. According to the developing sleeve, it is possible to draw up and convey more amount of developer, on the front surface which has high frictional resistance as the front surface is roughened. However, the front surface gradually becomes smooth in accordance with the abrasion due to rubbing with the developer. In particular, similarly to the first embodiment, when the area in which Fr becomes flat or attenuates is provided in the vicinity of the drawing-up pole, the magnetic force in the vicinity of the drawing-up pole further decreases than in the conventional configuration illustrated in FIG. 5. Accordingly, when the front surface on the developing sleeve gradually becomes smooth in accordance with the abrasion, there is a case where the conveying amount of the developer gradually decreases. As a result, the coating amount of the developer decreases as the conveying amount of the developer decreases, and there is a possibility that it is difficult to obtain images having stabilized quality over a long period of time.

Here, in the embodiment, the grooved sleeve is employed as the developing sleeve 103A. According to this, since it is possible to capture the developer by the plurality of grooves provided on the front surface and convey the developer with high efficiency, it is possible to obtain the images having stabilized quality over a long period of time. As illustrated in FIG. 10B, the plurality of grooves of the developing sleeve 103A are respectively formed in a cross-sectional V shape which is orthogonal to the rotation shaft of the developing sleeve 103A, and are disposed in the entire circumferential direction with a substantially equivalent interval. In the embodiment, an outer diameter of the developing sleeve 103A is 20 mm, a depth of each groove is 100 μm, an angle which is made of side surfaces of the grooves is 90°, and the number of grooves is 80.

In this manner, by employing the developing sleeve 103A having the plurality of grooves, it is possible to maintain stabilized developer conveying performance over a long period of time. As a result, when the magnet illustrated in the first embodiment is employed, it is also possible to provide the image forming apparatus which can form the stabilized images over a long period of time.

In addition, the developing sleeve 103A having the plurality of grooves similarly to the embodiment can also be employed in the second embodiment. Similarly to this case, when the magnet illustrated in the second embodiment is employed, it is also possible to provide the image forming apparatus which can form the stabilized images over a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-042484, filed Mar. 5, 2014 which is hereby incorporated by reference herein in its entirety.

What is claimed is:

1. A developing unit, comprising:

a developing container configured to store a developer including a non-magnetic toner and a magnetic carrier;

a developing sleeve configured to bear the developer on a surface thereof, and to rotate;

a developer regulating member configured to regulate an amount of the developer born on the developing sleeve; and a magnetic field generating portion configured to be fixed within the developing sleeve, and to have a plurality of fixed magnetic poles which generate a magnetic field which bears the developer on the developing sleeve, wherein the magnetic field generating portion includes (i) a cut pole which is disposed to oppose the developer regulating member and is closest to the developer regulating member among the magnetic poles, (ii) a drawing-up pole which is disposed adjacent to the cut pole on an upstream side in a direction of rotation of the developing sleeve and has an opposite polarity from the cut pole, and (iii) a peeling pole which is disposed adjacent to the drawing-up pole on the upstream side in the direction of rotation of the developing sleeve and has a same polarity as the drawing-up pole, and when a magnetic force in a direction toward a center of the developing sleeve is Fr, and a magnetic force in a tangential direction of the surface of the developing sleeve is Fθ, in a peak-to-peak area which is a region from a peak of magnetic flux density of the drawing-up pole to a peak of magnetic flux density of the cut pole, the magnetic field generating portion is configured to be arranged such that a distribution of Fr in a circumferential direction of the developing sleeve has an Fr flat area in which Fr is substantially constant or an Fr attenuation area in which Fr attenuates toward the cut pole side from the drawing-up pole side, and Fθ is oriented toward the same direction as the direction of rotation of the developing sleeve in the entire peak-to-peak area, and when an increase amount of Fr per unit angle is ΔFr, the Fr flat area satisfies $\Delta Fr \leq +5\times10^{-9}$(N) in the circumferential direction of the developing sleeve.

2. The developing unit according to claim 1, wherein the magnetic field generating portion is configured such that in a half-value area in which a magnetic flux density becomes an absolute value which is greater than an absolute value of a half of a peak value of the magnetic flux density of the drawing-up pole, the Fθ is oriented toward the same direction as the direction of rotation of the developing sleeve.

3. The developing unit according to claim 1, wherein the magnetic field generating portion is configured such that, with respect to the direction of rotation of the developing sleeve, in an entire angle area from a peak position of the magnetic flux density of the cut pole to a peak position of the magnetic flux density of a developing pole which is closest to a photoconductive member among the magnetic poles, Fθ is oriented toward the same direction as the direction of rotation of the developing sleeve.

4. The developing unit according to claim 1, wherein when an angle which is made of the peak-to-peak area is A, and an angle which is made of the Fr flat area or the Fr attenuation area is B, $0.12 \leq B/A < 0.65$ is satisfied.

5. The developing unit according to claim 1, wherein the developing sleeve has a plurality of grooves which are respectively formed in a direction which intersects a circumferential direction on the surface of the developing sleeve.

6. The developing unit according to claim 1, wherein a ratio of a total angle which is made of all areas of the Fr flat area and the Fr attenuation area for an angle which is made of the peak-to-peak area, is more than 0.12 and less than 0.65.

7. The developing unit according to claim 1, wherein the magnetic flux density of the cut pole is 350 G to 800 G, the magnetic flux density of the drawing-up pole is 150 G to 700

G, and a peak value of the magnetic flux density of the cut pole is larger than a peak value of the magnetic flux density of the drawing-up pole.

8. The developing unit according to claim 1, wherein in the Fr flat area or the Fr attenuation area, a numerical value range of Fr is from $1\times10^{-8}$ (N) to $1.5\times10^{-7}$ (N).

9. The developing unit according to claim 1, wherein Fθ is oriented toward the same direction as the direction of rotation of the developing sleeve in the entire area from a peak position of the magnetic flux density of the drawing-up pole to a position in which a distal end of the developer regulating member opposes the developing sleeve.

10. A developing unit, comprising:

a developer bearing member configured to be rotatable, to bear a developer including a non-magnetic toner and a magnetic carrier on a surface thereof, and to develop an electrostatic latent image;

a regulating member configured to regulate an amount of the developer born on the developer bearing member; and a magnet configured to be fixed within the developer bearing member and to generate a magnetic field on the surface of the developer bearing member, the magnet including a plurality of magnetic poles disposed in a circumferential direction of the developer bearing member, wherein the plurality of magnetic poles includes a first magnetic pole, a second magnetic pole which is disposed adjacent to the first magnetic pole on a downstream side in a direction of rotation of the developer bearing member and has a same polarity as the first magnetic pole, and a third magnetic pole which is disposed adjacent to the second magnetic pole on the downstream side in the direction of rotation of the developer bearing member and has an opposite polarity from the second magnetic pole, the third magnetic pole disposed at a position which is closest to the regulating member among the plurality of magnetic poles, and the magnet is configured such that Fθ is oriented toward the same direction as the direction of rotation of the developer bearing member in an entire peak-to-peak area which is a region from a peak position of the second magnetic pole to a peak position of the third magnetic pole, and a distribution of Fr has an Fr attenuation area in which Fr attenuates toward the peak position of the third magnetic pole from the peak position of the second magnetic pole, where a magnetic force in a normal line direction of the surface of the developer bearing member is Fr, the magnetic force toward a center of the developer bearing member is a positive magnetic force, and a magnetic force in a tangential direction of the surface of the developer bearing member is Fθ.

11. The developing unit according to claim 10, wherein a relationship of $0.12\leq A/B<0.65$ is satisfied, where an angle which is made of the Fr attenuation area in the circumferential direction of the developer bearing member is A, and an angle which is made of the peak-to-peak area in the circumferential direction of the developer bearing member is B.

12. The developing unit according to claim 10, wherein the magnet is configured such that Fθ is oriented toward the same direction as the direction of rotation of the developer bearing member in a half-value area of the second magnetic pole.

13. The developing unit according to claim 10, wherein the plurality of magnetic poles includes a fourth magnetic pole which is disposed adjacent to the third magnetic pole on the downstream side in the direction of rotation of the developer bearing member and has the opposite polarity as the third magnetic pole, and Fθ is oriented toward the same direction as the direction of rotation of the developer bearing member in an entire area from the peak position of the third magnetic pole to a peak position of the fourth magnetic pole.

14. The developing unit according to claim 10, wherein the surface of the developer bearing member is subjected to a blast processing.

15. The developing unit according to claim 10, wherein a plurality of grooves which are respectively formed along a direction which intersects the direction of rotation of the developer bearing member are formed on the surface of the developer bearing member.

16. The developing unit according to claim 10, wherein a peak intensity of a magnetic flux density of the second magnetic pole is lower than a peak intensity of a magnetic flux density of the third magnetic pole, the magnetic flux density of the second magnetic pole is equal to or higher than 150 (G) and is equal to or lower than 700 (G), and the magnetic flux density of the third magnetic pole is equal to or higher than 350 (G) and is equal to or lower than 800 (G).

17. The developing unit according to claim 10, wherein the magnetic force of Fr in the Fr attenuation area is equal to or higher than $1.0\times10^{-8}$(N) and is equal to or lower than $1.5\times10^{-7}$(N).

18. The developing unit according to claim 10, wherein Fθ is oriented toward the same direction as the direction of rotation of the developer bearing member in an entire area from the peak position of the second magnetic pole to a position which opposes the regulating member.

19. The developing unit according to claim 10, wherein a rate of the Fr attenuation area in the peak-to-peak area is equal to or higher than 0.12 and is equal to or lower than 0.65.

20. The developing unit according to claim 10, wherein Fθ is oriented toward the same direction as the direction of rotation of the developer bearing member in an entire area from the peak position of the second magnetic pole to a position which opposes the regulating member.

21. A developing unit, comprising:

a developer bearing member configured to be rotatable, to bear a developer including a non-magnetic toner and a magnetic carrier on a surface thereof, and to develop an electrostatic latent image;

a regulating member configured to regulate an amount of the developer born on the developer bearing member; and a magnet configured to be fixed within the developer bearing member and to generate a magnetic field on the surface of the developer bearing member, the magnet including a plurality of magnetic poles disposed in a circumferential direction of the developer bearing member, wherein the plurality of magnetic poles includes a first magnetic pole, a second magnetic pole which is disposed adjacent to the first magnetic pole on a downstream side in a direction of rotation of the developer bearing member and has a same polarity as the first magnetic pole, and a third magnetic pole which is disposed adjacent to the second magnetic pole on the downstream side in the direction of rotation of the developer bearing member and has an opposite polarity from the second magnetic pole, and the third magnetic pole disposed at a position which is closest to the regulating member among the plurality of magnetic poles, the magnet is configured such that Fθ is oriented toward the same direction as the direction of rotation of the developer bearing member in an entire peak-to-peak area which is a region from a peak position of the second magnetic pole to a peak position of the third magnetic pole, and a distribution of Fr has an Fr flat area in which an increase amount of Fr per unit angle from the peak position of the second magnetic pole toward the peak position of the third magnetic pole in the circumferential direction of the developer bearing member is equal to or lower than $5.0\times10^{-9}$(N), where a magnetic force in a normal line direction of the surface of the developer bearing member is Fr, the magnetic force toward a center of the developer bearing member is a positive magnetic force, and a magnetic force in a tangential direction of the surface of the developer bearing member is Fθ.

22. The developing unit according to claim 21, wherein a relationship of $0.12\leq A/B<0.65$ is satisfied, where an angle which is made of the Fr flat area in the circumferential direction of the developer bearing member is A, and an angle which is made of the peak-to-peak area in the circumferential direction of the developer bearing member is B.

23. The developing unit according to claim 21, wherein the magnet is configured such that Fθ is oriented toward the same direction as the direction of rotation of the developer bearing member in a half-value area of the second magnetic pole.

24. The developing unit according to claim 21, wherein the plurality of magnetic poles includes a fourth magnetic pole which is disposed adjacent to the third magnetic pole on the downstream side in the direction of rotation of the developer bearing member and has the opposite polarity as the third magnetic pole, and Fθ is oriented toward the same direction as the direction of rotation of the developer bearing member in an entire area from the peak position of the third magnetic pole to a peak position of the fourth magnetic pole.

25. The developing unit according to claim 21, wherein the surface of the developer bearing member is subjected to a blast processing.

26. The developing unit according to claim 21, wherein a plurality of grooves which are respectively formed along a direction which intersects the direction of rotation of the developer bearing member are formed on the surface of the developer bearing member.

27. The developing unit according to claim 21, wherein a peak intensity of a magnetic flux density of the second magnetic pole is lower than a peak intensity of a magnetic flux density of the third magnetic pole, the magnetic flux density of the second magnetic pole is equal to or higher than 150 (G) and is equal to or lower than 700 (G), and the magnetic flux density of the third magnetic pole is equal to or higher than 350 (G) and is equal to or lower than 800 (G).

28. The developing unit according to claim 21, wherein the magnetic force of Fr in the Fr flat area is equal to or higher than $1.0\times10^{-8}$(N) and is equal to or lower than $1.5\times10^{-7}$(N).

29. The developing unit according to claim 21, wherein Fθ is oriented toward the same direction as the direction of rotation of the developer bearing member in an entire area from the peak position of the second magnetic pole to a position which opposes the regulating member.

30. The developing unit according to claim 21, wherein a rate of the Fr flat area in the peak-to-peak area is equal to or higher than 0.12 and is equal to or lower than 0.65.

31. A developing unit, comprising:

a developer bearing member configured to be rotatable, to bear a developer including a non-magnetic toner and a magnetic carrier on a surface thereof, and to develop an electrostatic latent image;

a regulating member configured to regulate an amount of the developer born on the developer bearing member; and a magnet configured to be fixed within the developer bearing member and to generate a magnetic field on the surface of the developer bearing member, the magnet including a plurality of magnetic poles disposed in a circumferential direction of the developer bearing member, wherein the plurality of magnetic poles includes a first magnetic pole, a second magnetic pole which is disposed adjacent to the first magnetic pole on a downstream side in a direction of rotation of the developer bearing member and has a same polarity as the first magnetic pole, and a third magnetic pole which is disposed adjacent to the second magnetic pole on the downstream side in the direction of rotation of the developer bearing member and has an opposite polarity from the second magnetic pole, the third magnetic pole disposed at a position which is closest to the regulating member among the plurality of magnetic poles, the magnet is configured such that Fθ is oriented toward the same direction as the direction of rotation of the developer bearing member in an entire peak-to-peak area which is a region from a peak position of the second magnetic pole to a peak position of the third magnetic pole, and a distribution of Fr has an Fr attenuation area in which Fr attenuates toward the peak position of the third magnetic pole from the peak position of the second magnetic pole and an Fr flat area in which an increase amount of Fr per unit angle from the peak position of the second magnetic pole toward the peak position of the third magnetic pole in the circumferential direction of the developer bearing member is equal to or lower than $5.0\times10^{-9}$(N), where a magnetic force in a normal line direction of the surface of the developer bearing member is Fr, the magnetic force toward a center of the developer bearing member is a positive magnetic force, and a magnetic force in a tangential direction of the surface of the developer bearing member is Fθ.

32. The developing unit according to claim 31, wherein a rate of the Fr attenuation area and the Fr flat area in the peak-to-peak area is equal to or higher than 0.12 and is equal to or lower than 0.65.

33. The developing unit according to claim 31, wherein the magnet is configured such that Fθ is oriented toward the same direction as the direction of rotation of the developer bearing member in a half-value area of the second magnetic pole.

34. The developing unit according to claim 31, wherein the plurality of magnetic poles includes a fourth magnetic pole which is adjacent to the third magnetic pole on the downstream side in the direction of rotation of the developer bearing member and has the opposite polarity as the third magnetic pole, and Fθ is oriented toward the same direction as the direction of rotation of the developer bearing member in an entire area from the peak position of the third magnetic pole to a peak position of the fourth magnetic pole.

35. The developing unit according to claim 31, wherein the surface of the developer bearing member is subjected to a blast processing.

36. The developing unit according to claim 31, wherein a plurality of grooves which are respectively formed along a direction which intersects the direction of rotation of the developer bearing member are formed on the surface of the developer bearing member.

37. The developing unit according to claim 31, wherein a peak intensity of a magnetic flux density of the second magnetic pole is lower than a peak intensity of a magnetic flux density of the third magnetic pole, the magnetic flux density of the second magnetic pole is equal to or higher than 150 (G) and is equal to or lower than 700 (G), and the magnetic flux density of the third magnetic pole is equal to or higher than 350 (G) and is equal to or lower than 800 (G).

38. The developing unit according to claim 31, wherein the magnetic force of Fr in the Fr attenuation area and the Fr flat area are respectively equal to or higher than $1.0\times10^{-8}$(N) and are equal to or lower than $1.5\times10^{-7}$(N).

* * * * *